US006380522B1

(12) United States Patent
Bochud

(10) Patent No.: US 6,380,522 B1
(45) Date of Patent: Apr. 30, 2002

(54) DEVICE FOR THE REGULATION OF A GENERATOR OF A HOT FLUID IN LIQUID OR GASEOUS PHASE

(75) Inventor: Eric Bochud, Granges-Paccot (CH)

(73) Assignee: Ecovap S.A., La Chaux-de-Fonds (CH)

( * ) Notice: Subject to any disclaimer, the term of this patent is extended or adjusted under 35 U.S.C. 154(b) by 0 days.

(21) Appl. No.: 09/705,879

(22) Filed: Nov. 6, 2000

(30) Foreign Application Priority Data

Nov. 4, 1999 (EP) ..... 99121859

(51) Int. Cl.[7] ..... H05B 1/02

(52) U.S. Cl. ..... 219/497; 219/494; 219/489; 392/342; 392/400

(58) Field of Search ..... 219/496, 497, 219/494, 501, 506, 489; 392/324, 342, 386, 399, 400

(56) References Cited

U.S. PATENT DOCUMENTS 5,278,937 A * 1/1994 Alix et al. ..... 392/402
5,559,293 A * 9/1996 Kirkpatrick ..... 73/861

* cited by examiner

*Primary Examiner*—Mark Paschall
(74) *Attorney, Agent, or Firm*—Young & Thompson

(57) ABSTRACT

The device for regulation of a generator of hot fluid in liquid or gaseous phase comprises a vat provided with at least one heating body, a pump for supplying the vat with cold liquid, and at least one appliance supplied by the hot fluid leaving the vat. This regulation device comprises a detector (15, 20, 24) of the liquid level present in the vat, comprising a float (15, 16) connected by a flexible tube (20) to a ferrule (24) passing in sealed fashion through the cover of the vat. An angle switch (M) is disposed immediately adjacent the float (15, 16), its electrical conductor leaving the vat through said flexible tube (20).

12 Claims, 4 Drawing Sheets

DEVICE FOR THE REGULATION OF A GENERATOR OF A HOT FLUID IN LIQUID OR GASEOUS PHASE

BACKGROUND OF THE INVENTION

The present invention relates to generators for hot fluid, in liquid or gaseous phase and more particularly to a device for regulation of these generators.

In general, it relates to hot water or steam generators, but the invention is also applicable to generators for other hot liquids or gases.

To guarantee good operation of such a generator, it is necessary to limit the impact of the introduction into the vat of the generator of the cold liquid according to the use of the hot liquid or the vapor of this liquid. It is thus necessary frequently to introduce small doses of cold liquid.

Similarly, to guarantee constant pressure energy stored in the vat of the generator, it is necessary to be able to maintain a constant value of the distribution of the volumes of liquid and gas in said vat.

To achieve these objects, it is necessary to measure or detect the liquid level in the vat of the generator with high precision, to adjust the addition of liquid and the thermal power in a sufficiently precise manner. This is not the case in existing generators and one of the principal objects of the invention is to provide a process and a device for fine and precise regulation of the liquid level in the vat of the generator.

Moreover, existing generators are generally regulated as to pressure, which is to say that the supply of the heating body or bodies of the vat is controlled by a pressure detector. The thermal inertia of these vats is not negligible, so that after having reached the desired pressure in the vat and hence having cut off the supply to the heating bodies, the temperature of the liquid in the vat continues to increase and hence also the pressure, giving rise to uncontrolled exceeding of the reference pressure in the vat. Another object of the present invention is to provide a new process as well as a device for regulation avoiding as much as possible exceeding the reference pressure in the vat of the generator.

These hot liquid or gas generators are adapted to be polyvalent and to be able to supply particularly steam to several different utensils or appliances. It is evident that the electric power assigned to heating the liquid varies according to the envisaged application, it is less for use of a steam iron than for supplying an appliance for steam cleaning. Generally, to avoid overconsumption, these generators are provided with a switch permitting manually adjusting the heating power to two pre-established levels. This is however often not satisfactory, because the user forgets to switch the supply of the heating body when changing the appliance. Still another object of the present invention is to permit the control of the heating power automatically as a function of the appliance used.

Finally, the last object of the present invention is to facilitate the maintenance of the hot water and hot gas generators by providing them with devices permitting having access to the condition of the components of the generator without first disassembling the apparatus.

SUMMARY OF THE INVENTION

The present invention has for its object a device for the regulation of a hot fluid generator in liquid or gaseous phase, which overcomes the drawbacks of the existing systems and which permits achieving all or a portion of the objects mentioned above.

BRIEF DESCRIPTION OF THE DRAWINGS

The accompanying drawings show schematically two embodiments of the device for regulation of a hot fluid generator, liquid or gas, according to the present invention.

DETAILED DESCRIPTION OF THE PREFERRED EMBODIMENTS

Figure 1:
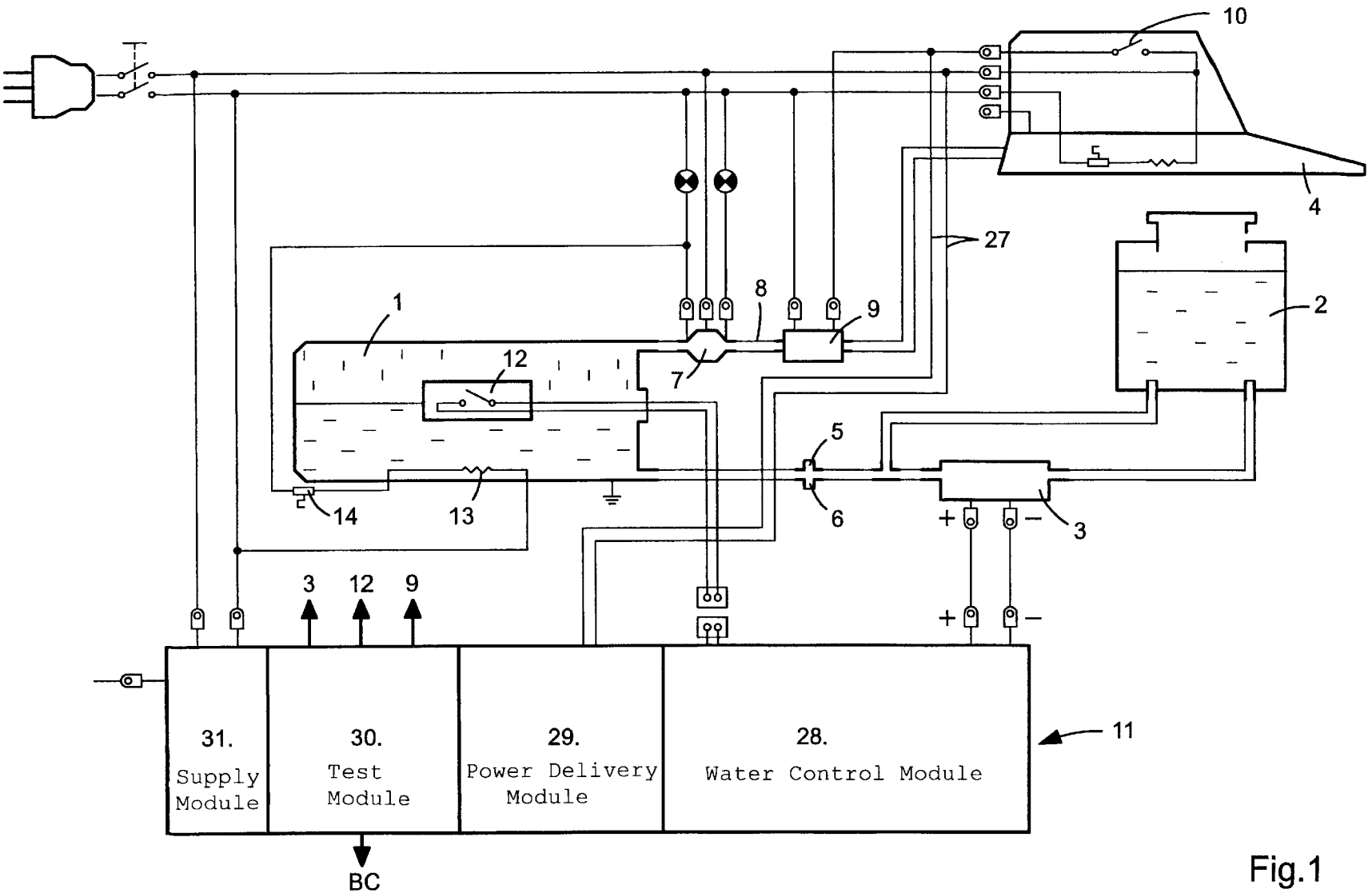
FIG. 1 is a diagram showing the first embodiment of the regulation device.

The first embodiment of the regulation device for a hot fluid generator, in liquid or gaseous phase, is shown schematically in FIG. 1. The installation described with reference to the drawing relates to a steam generator supplying as desired a steam iron or another appliance such as a steam cleaning device.

This installation comprises a steam generator 1 for example, constituted as is described in WO/98/36215, but which could also comprise a vat only of aluminum.

The installation moreover comprises a water basin 2, a pump 3 supplying the vat of the generator 1 with cold water, and an appliance 4 to be used, in this case, a steam iron.

The pump 3 is supplied with cold water from the water basin 2 and its outlet supplies the vat 1 of the steam generator. Between the pump 3 and the vat 1 is located an over-pressure water supply valve 5 as well as a water under-pressure valve 6.

A pressostat 7 is located in the steam outlet conduit 8 which comprises a steam outlet electrovalve 9 which supplies the steam iron 4 and is controlled manually by the user with a switch 10 which is included in the steam iron 4.

The installation also comprises an electronic control unit 11. This electronic control unit 11 regulates the supply of water of the vat 1 by the pump 3 as a function of the water level detected in the vat by a level detector 12.

The vat 1 comprises a heating body 13 whose electrical supply is controlled by the pressostat 7, a safety thermostat 14 limits the maximum temperature of the vat 1.

For good operation of the installation, it is necessary that the cold water be introduced into the vat 1 preferably in its portion occupied by the gas and not by the liquid and above all it is necessary that this cold water supply take place by small successive quantities to avoid thermal shocks and variations of the temperature contained in the vat 1.

This regulation of the introduction of cold water by the pump 3 into the vat is controlled by the control unit 11 as a function of the information supplied to it by the level detector 12. This level detector must be very sensitive and be able to detect variations of water level in the vat 1 of the order of 1 to 3 mm, preferably 1 to 2 mm.

Figure 2:
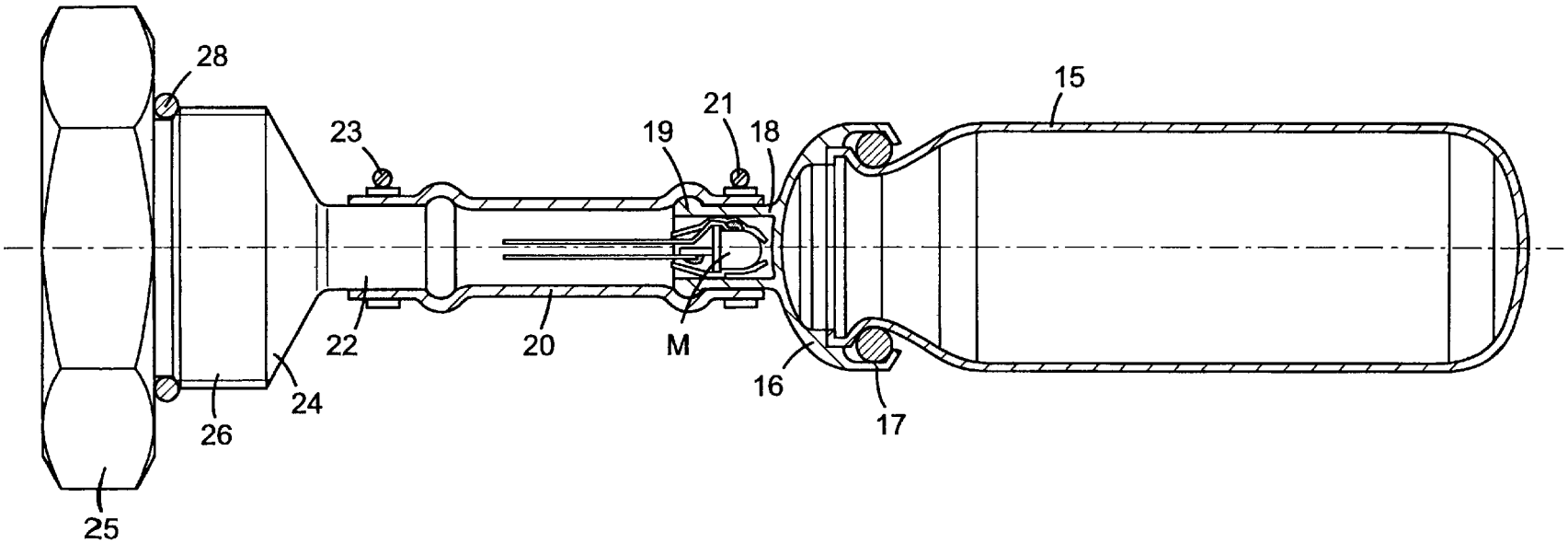
FIG. 2 is a fragmentary longitudinal cross-sectional view of a liquid level detector contained in the vat of the generator.

To permit such a precise regulation of the water level in the vat, a detector has been developed which is shown in FIG. 2.

This substantially cylindrical vat 1 is disposed in service position with its longitudinal axis substantially horizontal. The cover of the vat 1 forms one of the ends of the latter and comprises passages for all the supply and outlet of water, electricity, etc.

This level detector is fixed on the cover of the vat 1, approximately along its axis, and extends substantially horizontally to the axis within said vat 1. It comprises a float in the form of an aluminum bottle 15 closed by a cover 16 also of aluminum. This cover comprises a torric sealing joint, in the illustrated example, and the flange 17 of the cover is cold set over the opening of the bottle 1 so as to obtain perfect and durable sealing in operating conditions of the temperature and pressure required, namely, more than 110° C. at 3 to 6 bars pressure.

It is important that the buoyancy of this float be high, because it is necessary that its buoyancy be only little influenced by scale deposits which can form thereon during use of the generator. A cylindrical bottle of 15 to 20 mm diameter and a length of 40 to 60 mm, serves for the envisaged uses.

The joint between the cover 16 and the bottle 15 is preferably an O-ring joint of silicone of a hardness of 45 to 70 Shore.

The cover 16, forming with the bottle 15 the float, comprises at its end remote from the bottle 15 a blind tubular portion 18 whose end portion of the wall comprises an enlargement 19. Over this tubular portion 18 of the cover 16 is slipped a flexible transparent silicone tube 20 of a hardness of the order of 45 to 70 Shore which can resist a service temperature comprised between −60° to +200° C. A clamping ring 21 of stainless steel fixes this tube 20 on the tubular portion 18 of the cover in a sealed manner.

The other end of the tube 20 is slipped over the tubular portion 22 of a ferrule 24 and is clamped thereon by a second stainless steel ring 23. This ferrule 24 comprises a through passage, its free end is provided with a hex nut 25 and its intermediate portion 26 is provided with screw threading adapted to be screwed into a tapped hole in the cover of the vat of the generator. A joint 28 ensures sealing. Thus, in service position, the level detector is disposed within the vat, approximately along the longitudinal axis of the latter and hence horizontally, and is connected to the cover of the generator vat by the flexible tube 20.

An angle switch, for example a mercury switch M, is disposed and fixed in the tubular portion 18 of the cover 16 of the float 15 and its conducting wires extend through the tube 20 and the ferrule 24 to exit the vat 1 and be connected to the electronic control unit 11.

Such a level detector is very precise, it permits detecting differences of level in the vat of the order of 1 to 3 mm, it is very reliable and of long lifetime, particularly because of the high buoyancy of the float. Moreover, this detector can be removed from the vat 1 of the generator simply by unscrewing the ferrule 24, without the cover of the vat 1 having to be disassembled. Thus, in case of need, a standard exchange of the detector is easily carried out. The advantage of a horizontal detector is that it follows the level of the water in the vat. The changes in water level give rise to a modification of the inclination of the float. The detection of such a modification can take place with the aid of a single angle switch, the freedom of movement of the float being restricted. Thanks to this level detector, which is very sensitive and simple because it need comprise only one switch, the regulation of the water level within the vat 1 takes place by successive introduction of cold liquid of small quantity, avoiding any interference or variation with the temperature in the vat, the volume of liquid introduced being small relative to the volume of liquid contained in the vat. Moreover, the introduction of cold water into the vat takes place in the portion of the latter containing the vapor or gas, which also reduces disturbances caused by calcium carbonate.

Also, thanks to this very sensitive level detector, it is possible in operation of the generator to maintain practically constant the pressure energy stored in the vat because the distribution of the volume of water and steam remains practically constant in the course of operation.

This precise regulation of the liquid level therefore guarantees stable conditions of operation of the steam generator.

The regulation device which is the object of the invention also permits automatic control of the electric heating power delivered to the heating body 13 of the vat 1 as a function of the appliance used, for example a steam iron or a device for steam cleaning.

To this end, the accessory 4 is, during its connection to the generator, connected to the electronic control unit 11 by an electric conductor 27 delivering to this unit information identifying the appliance 4. This identification information automatically controls the electric power delivered to the heating body of the vat.

In this way, there can be obtained from the apparatus maximum efficiency in all its uses. This characteristic permits continuously properly using all the installed electric power. The automatic recognition of the appliance used, by the electric control unit, also avoids any risk of overconsumption.

The electronic control unit thus comprises a module 28 for control of the introduction of water into the vat of the generator, controlled by the level detector, as well as a module 29 for control of the power delivered to the heating body of the vat, controlled by the appliance coupled to the generator.

In a modification, the electronic control unit also comprises a test module 30 comprising at least one counter totalizing the time of operation of the generator. It is thus possible to obtain at any moment information for the user or which can be useful in maintenance. Thanks to this counter of the duration of operation, it is possible to communicate to the user or to the maintenance service that it is time to proceed with maintenance of the generator, for example descaling, to maintain its effectiveness and its reliability at maximum level. Complementing this counter of the duration of operation of the generator, the test module can comprise circuits delivering information on the condition of the principal components of the generator, such as the heating body, the flow, the water level alarm, the pump, etc.

Thus by connecting the test module to a control bank BC, the maintenance service can immediately know the condition of the components of the generator and easily and rapidly detect a malfunction.

The electronic control unit of course comprises a supply module 31 for electrical energy.

For higher power generators, the regulation by pressostat, namely subjection to the internal pressure of the vat, has an important drawback. Because of the thermal inertia of the heating bodies and of the vat of the generator when the reference pressure is achieved, and when the supply is cut off to the heating body, the increase in temperature and pressure of the water and the steam in the vat continues.

Figure 4:
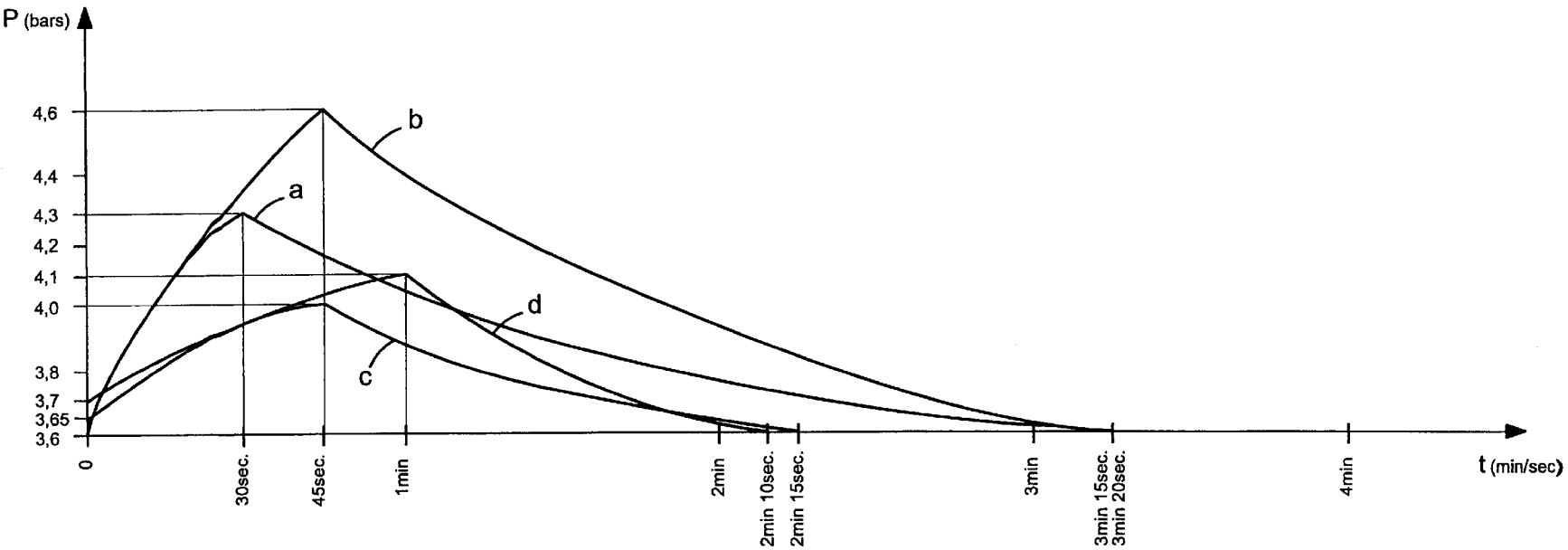
FIG. 4 is a diagram illustrating for aluminum and hooped aluminum vats a stainless steel drum, the pressure curves as a function of time for regulation by a pressostat and regulation as to temperature according to the invention.

The curves a and b in FIG. 4 show this exceeding of the pressure, or increase of pressure due to the thermal inertia of the generator. For an aluminum vat, this pressure increase is of the order of 0.7 bar (curve a), whilst for a vat of stainless steel clad with aluminum (curve b) this pressure increase can reach 1 bar. This type of constant pressure regulation therefore gives rise to unacceptable exceeding of the reference value when the installed power is high. The energy stored in the mass of the generator creates a time lag and gives rise to exceeding the reference value.

The present invention in its second embodiment relates to a regulation by subjecting the temperature of the vat of the generator which permits, as seen in FIG. 4, curves c and d, to reduce the pressure excess to about 0.3 bar for aluminum vats and 0.4 bar for vats that are mixed aluminum and stainless steel.

Figure 3:
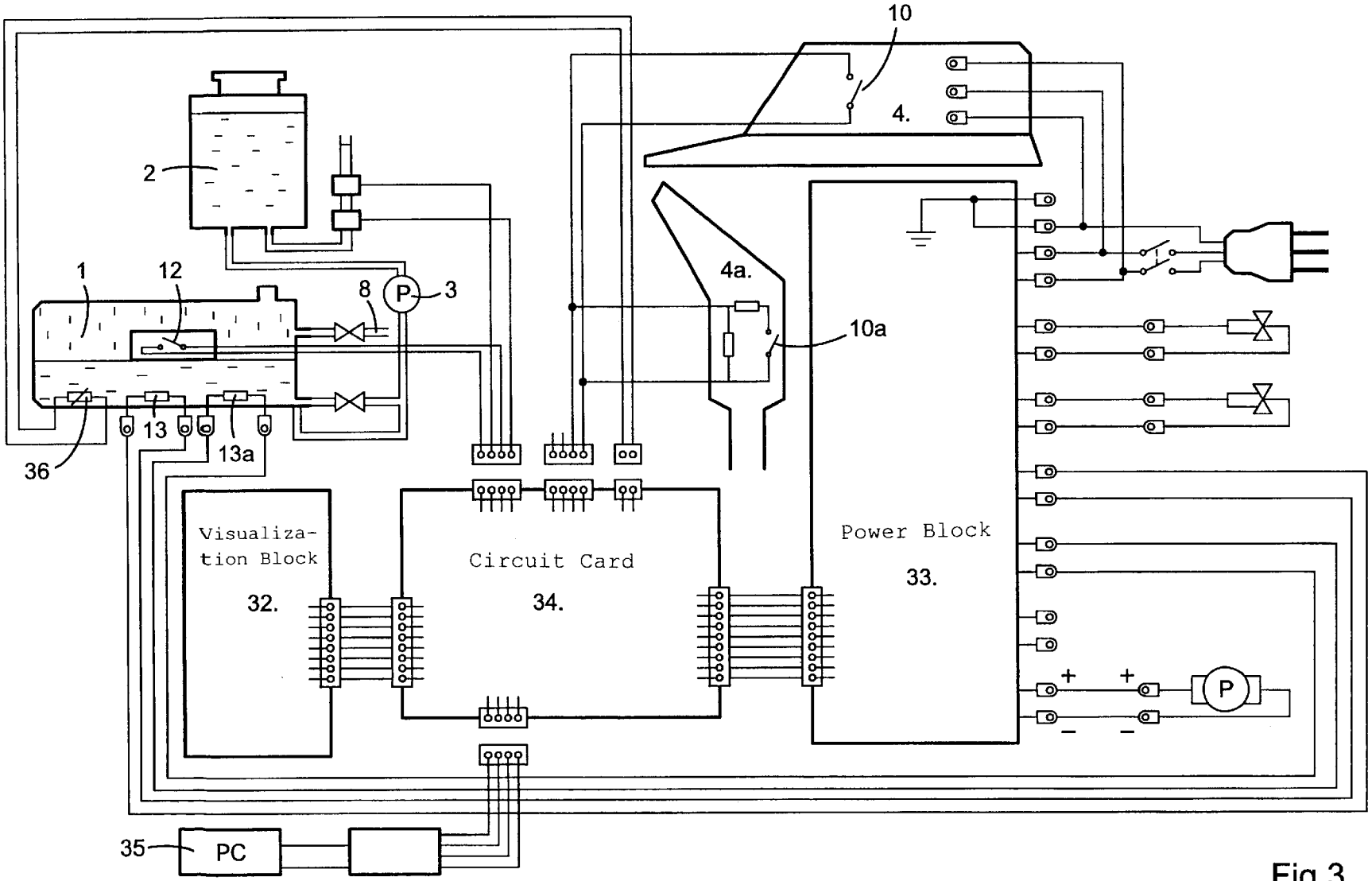
FIG. 3 is a diagram illustrating the second embodiment of the regulation device.

Such a regulation device by subjection to the temperature of the vat is shown in FIG. 3. The generator comprises a vat 1, a water vessel 2, a pump 3 and an appliance, a steam iron 4 or cleaning nozzle 4*a*. The vat 1 is provided with a level detector 12 as described above with reference to FIG. 2. This generator comprises in this embodiment two heating bodies 13 and 13*a*.

The electronic control unit comprises in this embodiment a visualization block 32, a power block 33 and a circuit card 34.

As in the first embodiment, the circuit card 34 comprises a control module for the introduction of water into the vat controlled by the level detector 12 and a water detector level in the water vessel, as well as a control module for the power delivered to the heating body, controlled by the appliance coupled to the generator.

This circuit card 34 also comprises a test module that can be connected to a test bank, here shown by an interface and a PC 35.

In this embodiment, the circuit card 34 of the electronic control unit also comprises a module for the regulation of the supply of the heating bodies 13, 13*a*. This module is controlled by a thermistor 36 which measures the temperature variations of the vat 1. This regulation module for the heating bodies establishes a sampling of the measurement of temperature to determine the slope of the temperature curve as a function of time. This image is necessary to control the vat. Subjection to the temperature is obtained by the bias of a PID (proportional, integrative, and derivative) regulator which integrates the optimum parameters of the system and takes account of the condition of the fluid outlet valve. Thus the thermal inertia of the generator is integrated for regulation, which permits a more stable operation and less exceeding of the pressure.

Thus, by the bias of a thermistor of the NTC (negative thermal characteristics) type for example, there can be obtained an image of the thermal development of the system, is which permits as a function of logic integrated into the circuit card, the best regulation of the heating power to limit the exceeding of the reference pressure. Thus, by regulating the heating power as a function of the development of the temperature of the vat, it is possible to anticipate a pressure increase and to limit it, which is not possible with a regulation controlled by a pressostat functioning in an all or nothing mode for a given pressure.

It should also be noted that to be able to carry out regulation of the water level in the vat and the supply to the heating body from temperature measurements carried out in the vat, it is necessary that this vat maintain a given orientation during all the duration of the use of the generator. To avoid any misfunction, the electronic control unit or the circuit card also comprises a position detector which places the generator in a safety mode if the vat does not occupy its pre-established operational position.

What is claimed is:

1. A combination of a generator and a device for regulating the generator, said generator generating hot fluid and comprising:

a vat having first and second longitudinal ends and at least one heating body, a longitudinal axis of the vat being substantially horizontal when the vat is in a service position, the vat comprising a cover, the cover being at one of the first and second longitudinal ends;

a pump for supplying the vat with cold fluid; and the device for regulating comprising:

a level detector for detecting a level of a liquid in the vat, the level detector having, a float connected by a flexible tube to a connection that sealably passes through the cover of the vat, the flexible tube and the float extending substantially horizontally within the vat; and only one angle switch the sole angle switch being outside the float, an electrical conductor of the sole angle switch extending through the flexible tube and the connection to outside the vat; and an electronic control unit controlling a starting and stopping of the pump according to data delivered by the level detector.

2. The combination according to claim 1, wherein the electronic control unit comprises a position detector of the vat that places the generator out of service when the longitudinal axis of the vat is other than substantially horizontal.

3. The combination according to claim 2, wherein the electronic control unit further comprises a module for regulating the electrical power delivered to the at least one heating body.

4. The combination according to claim 3, wherein when an appliance is connected to the generator, identification information as to the at least one appliance is delivered to the electronic control unit, the electronic control unit regulates as a function of the identification information, a heating power of the vat.

5. The combination according to claim 1, wherein the electronic control unit comprises a counter for totalizing an operating time of the generator.

6. The combination according to claim 5, further comprising a control bank that monitors the counter and a condition of the generator.

7. The combination according to claim 1, wherein the generator further comprises a thermistor to measure a temperature of the vat and wherein the electronic control unit comprises a module for regulating an electrical supply of the at least one heating body by establishing a signal proportional to a variation of the temperature of the vat with time, the signal takes into account a thermal inertia of the vat.

8. The combination according to claim 1, wherein the generator further comprises a pressostat controlling the electric supply of the at least one heating body.

9. The combination according to claim 1, wherein the float of the level detector is an aluminum bottle having a neck with an opening, the opening is closed by an aluminum cover clamped onto a silicone joint surrounding the neck.

10. The combination according to claim 9, wherein the flexible tube connecting the float to the connection is silicone.

11. The combination according to claim 9, wherein the sole angle switch is a mercury switch.

12. The combination according to claim 9, wherein the sole angle switch is in a tubular portion of the aluminum cover, outside the float, the tubular portion being connected by the silicone tube to the cover of the vat.

* * * * *